US009905361B2

(12) United States Patent
Shen et al.

(10) Patent No.: US 9,905,361 B2
(45) Date of Patent: Feb. 27, 2018

(54) MANUFACTURING METHOD OF COMMON GRAIN-ORIENTED SILICON STEEL WITH HIGH MAGNETIC INDUCTION

(71) Applicant: BAOSHAN IRON & STEEL CO., LTD., Shanghai (CN)

(72) Inventors: Kanyi Shen, Shanghai (CN); Guobao Li, Shanghai (CN); Shuangjie Chu, Shanghai (CN); Yezhong Sun, Shanghai (CN); Huabing Zhang, Shanghai (CN); Yongjie Yang, Shanghai (CN); Zhuochao Hu, Shanghai (CN); Bin Zhao, Shanghai (CN); Qi Xu, Shanghai (CN); Jie Huang, Shanghai (CN); Peili Zhang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 378 days.

(21) Appl. No.: 14/430,463

(22) PCT Filed: Dec. 11, 2012

(86) PCT No.: PCT/CN2012/001682

§ 371 (c)(1),
(2) Date: Mar. 23, 2015

(87) PCT Pub. No.: WO2014/047757

PCT Pub. Date: Apr. 3, 2014

(65) Prior Publication Data

US 2015/0255211 A1 Sep. 10, 2015

(30) Foreign Application Priority Data

Sep. 27, 2012 (CN) ..... 2012 1 0365931

(51) Int. Cl.

| | |
|---|---|
| ***H01F 41/02*** | (2006.01) |
| ***C21D 8/12*** | (2006.01) |
| ***C22C 38/04*** | (2006.01) |
| ***C22C 38/00*** | (2006.01) |
| ***C22C 38/02*** | (2006.01) |
| ***C22C 38/06*** | (2006.01) |
| ***H01F 1/18*** | (2006.01) |
| ***C21D 3/04*** | (2006.01) |
| ***C21D 6/00*** | (2006.01) |
| ***C23C 8/26*** | (2006.01) |
| ***H01F 1/147*** | (2006.01) |
| ***H01F 41/32*** | (2006.01) |

(52) U.S. Cl.

CPC ..... *H01F 41/02* (2013.01); *C21D 3/04* (2013.01); *C21D 6/008* (2013.01); *C21D 8/12* (2013.01); *C21D 8/1205* (2013.01); *C21D 8/1222* (2013.01); *C21D 8/1233* (2013.01); *C21D 8/1261* (2013.01); *C21D 8/1272* (2013.01); *C21D 8/1277* (2013.01); *C21D 8/1283* (2013.01); *C22C 38/001* (2013.01); *C22C 38/008* (2013.01); *C22C 38/02* (2013.01); *C22C 38/04* (2013.01); *C22C 38/06* (2013.01); *C23C 8/26* (2013.01); *H01F 1/14783* (2013.01); *H01F 1/14791* (2013.01); *H01F 1/18* (2013.01); *H01F 41/32* (2013.01); *C21D 2201/05* (2013.01)

(58) Field of Classification Search

CPC ..... H01F 41/02; C21D 3/04; C21D 6/008; C21D 8/12; C21D 38/001; C21D 38/02; C21D 38/04

See application file for complete search history.

(56) References Cited

U.S. PATENT DOCUMENTS

| | | | | |
|---|---|---|---|---|
| 5,049,205 | A | 9/1991 | Takahashi et al. | |
| 2011/0139313 | A1* | 6/2011 | Yang | C21D 1/26 148/522 |
| 2011/0180187 | A1* | 7/2011 | Ji | C21D 1/26 148/541 |
| 2012/0000262 | A1* | 1/2012 | Li | C21D 8/1283 72/200 |

(Continued)

FOREIGN PATENT DOCUMENTS

| | | |
|---|---|---|
| CN | 101768697 | 7/2010 |
| CN | 101845582 | 9/2010 |

(Continued)

OTHER PUBLICATIONS

International Preliminary Report on Patentability for PCT/CN2012/001682, dated Apr. 9, 2015.

*Primary Examiner* — Veronica F Faison
(74) *Attorney, Agent, or Firm* — Eversheds Sutherland (US) LLP

(57) ABSTRACT

A manufacturing method of oriented silicon steel with magnetic induction B8 of not less than 1.88 T, comprising the following steps: 1) smelting and continuous casting to obtain a slab, wherein the content of N is controlled at 0.002-0.014 wt % in the smelting stage; 2) hot-rolling; 3) cold-rolling; 4) decarbonizing and annealing; 5) nitriding treatment, wherein infiltrated nitrogen content $[N]_D$ is controlled to satisfy the formula: $328-0.14a-0.85b-2.33c \leq [N]_D \leq 362-0.16a-0.94b-2.57c$, wherein a is the content of Als in the smelting step, with the unit of ppm; b is the content of N element, with the unit of ppm; and c is primary grains size, with the unit of μm; 6) coating a steel's surfaces with a magnesium oxide layer and annealing; and 7) applying an insulating coating.

6 Claims, No Drawings

(56) References Cited

U.S. PATENT DOCUMENTS

| | | | | |
|---|---|---|---|---|
| 2013/0233450 | A1* | 9/2013 | Xu | C21D 8/12<br>148/522 |
| 2015/0206633 | A1* | 7/2015 | Zhang | C22C 38/001<br>148/111 |
| 2016/0111190 | A1* | 4/2016 | Boettcher | C21D 1/42<br>148/111 |

FOREIGN PATENT DOCUMENTS

| | | |
|---|---|---|
| JP | 2259016 | 10/1990 |
| JP | 4000323 | 1/1992 |

* cited by examiner

MANUFACTURING METHOD OF COMMON GRAIN-ORIENTED SILICON STEEL WITH HIGH MAGNETIC INDUCTION

CROSS-REFERENCE TO RELATED APPLICATIONS

This application claims priority to and benefit of PCT Application No. PCT/CN2012/001682, entitled "Manufacturing Method of Common Grain-Oriented Silicon Steel With High Magnetic Induction," filed Dec. 11, 2012, which claims the benefit of Chinese Patent Application No. 2012103659531.2 filed on Sep. 27, 2012, which are both incorporated herein by reference in their entirety.

FIELD OF THE INVENTION

The invention relates to a manufacturing method of a metal alloy, in particular to a manufacturing method of an iron-based alloy.

BACKGROUND OF THE INVENTION

Generally, existing common oriented silicon steel (CGO) uses MnS or MnSe as an inhibitor and is produced by adopting a two-time cold-rolling method. The two-time cold-rolling method comprises the following main production process:

smelting; hot-rolling; normalizing; primary cold-rolling; intermediate annealing;

secondary cold-rolling; decarbonizing and annealing; high-temperature annealing; and coating an insulation layer. The key technical points thereof are as follows:

Smelting: a slab is formed by performing steel making in a converter (or an electric furnace), performing secondary refining and alloying, and performing continuous casting, wherein the slab comprises the following basic chemical components by weight percent: 2.5-4.5% of Si, 0.02-0.10% of C, 0.025-0.25% of Mn, 0.01-0.035% of S or Se, not more than 0.01% of Al, not more than 0.005% of N, one or more of Cu, Mo, Sb, B, Bi and other elements which are contained in some component systems and the balance of iron and inevitable impurity elements.

Hot-rolling: generally, the slab is heated to the temperature of 1350° C. or more in a special high-temperature heating furnace, and is kept at the temperature for 45 min or more to realize full solid solution of a favorable inclusion MnS or MnSe and then 4-6 passes of rough rolling and finish rolling are performed. Through fast cooling between finish rolling and coiling, carbides can be dispersed and distributed in grains, thereby being favorable to obtaining small and uniform primary grains.

Normalizing: keeping at 850-950° C. for 3 min such that the structure of a hot-rolled plate is more uniform.

Primary cold rolling: the cold rolling reduction ratio is 60-70% and 3-4 passes of rolling are performed.

Intermediate annealing: the intermediate annealing temperature is 850-950° C. and the annealing time is 2.5-4.0 min.

Secondary cold-rolling: the secondary cold rolling reduction ratio after intermediate annealing is 50-55% and the number of passes of cold rolling is 2-3.

Decarbonizing and annealing: primary recrystallization is completed and secondary grain-shaped core points are formed after decarbonizing and annealing. The C content is removed till 30 ppm or less, thereby ensuring to be in a single a phase during subsequent high-temperature annealing, developing a perfect secondary recrystalized structure and eliminating magnetic aging of a finished product.

High-temperature annealing: the high-temperature annealing must be performed firstly to perform secondary recrystallization to grow secondary grains and then a layer of magnesium silicate bottom layer glass film is formed on the surface of a steel strip; and purifying and annealing are finally performed to remove S, N and other elements which are decomposed from the inhibitor and are harmful to magnetic property, and thus the common oriented silicon steel with high degree of orientation and ideal magnetic performance is obtained.

Insulating coating: by applying an insulating coating and performing stretching and annealing, an oriented silicon steel product in a commercial application form is obtained.

A Chinese patent document with publication number of CN1321787A and publication date of Nov. 14, 2001, entitled "Single-oriented electrical steel sheet and preparation method thereof", discloses a single-oriented electrical steel plate and a manufacturing method thereof. The manufacturing procedure of the method comprises the following steps: smelting raw materials, wherein the raw materials comprise the following chemical components by weight percent: 0.02-0.15% of C, 1.5-2.5% of Si, 0.02-0.20% of Mn, 0.015-0.065% of acid-soluble Al, 0.0030-0.0150% of N, 0.005-0.040% of one or two of S and Se, and the balance of Fe and other inevitable impurities; annealing a hot-rolled plate coil at the temperature of 900-1100° C., performing primary cold-rolling, decarbonizing, annealing, final annealing and final coating so as to obtain the electrical steel plate with the plate thickness of 0.20-0.55 mm and the average crystal grain size of 1.5-5.5 mm, wherein the iron loss value $W_{17/50}$ satisfies that the formula: $0.5884e^{1.9154\times plate\ thickness(mm)} \leq W_{17/50}$ (W/kg)$\leq 0.7558e^{1.7378\times plate\ thickness(mm)}$, and the value of B8 (T) satisfies the formula: $1.88 \leq B8(T) \leq 1.95$.

A US patent document with publication number of U.S. Pat. No. 5,039,359 and publication date of Aug. 13, 1991, entitled "Manufacturing method of grain oriented electrical steel plate with excellent magnetic property", relates to a manufacturing method of an electrical steel plate with excellent magnetic property, and the manufacturing method comprises the following steps: smelting molten steel, wherein the molten steel comprises the following chemical components by weight percent: 0.021-0.100 wt % of C and 2.5-4.5 wt % of Si, as well as a silicon steel plate forming inhibitor, and the balance of iron and other inevitable impurities; forming a hot-rolled and coiled steel plate, wherein the coiling and cooling temperature is not more than 700° C., and the temperature is lower 80% or more than the actual temperature of the hot-rolled and coiled steel plate; balancing one or more elements in the composition of a working table of the hot-rolled steel plate; and performing at least one time cold-rolling for producing the oriented silicon steel, wherein the magnetic induction of the product can be 1.90 T or more.

A US patent document with publication number of U.S. Pat. No. 5,472,521 and publication date of Dec. 5, 1995, entitled "Manufacturing method of grain oriented electrical steel plate with excellent magnetic property", discloses a manufacturing method of an electrical steel plate with improved magnetic property and stable grain orientation. Oriented silicon steel is produced by adopting a low-temperature slab heating technology and a normalizing-free primary cold-rolling process, and the patent simultaneously relates to the relation of nitrogen content after smelting and magnetic induction of the steel plate.

The above prior arts having following shortcomings:

(1) MnS or MnSe is adopted as a main inhibitor, thereby resulting in relatively low magnetic property of a finished product;

(2) in order to realize full solution of the MnS or MnSe inhibitor, the highest heating temperature needs to reach 1400° C., which is the limit level of a traditional heating furnace; in addition, due to high heating temperature and great burning loss, the heating furnace needs to be repaired frequently and the utilization rate is low; and meanwhile, because high heating temperature leads to high energy consumption and edge crack of a hot-rolled coil is large, in the cold-rolling procedure, it is difficult to produce, the yield is low and the cost is high;

(3) under the existing chemical component system, a common oriented silicon steel finished product with a suitable magnetic property can be obtained only when the whole production process uses normalizing, intermediate annealing and a secondary cold-rolling method, which results in complicated procedure, long manufacturing process flow and over-low production efficiency; and (4) MnS or MnSe is complete solid-soluble non-nitriding type in the existing common oriented silicon steel, and because the reheating temperature of a slab is too high in the actual production thereof, the strength of the inhibitor in the slab is non-uniform, and it easy to generate coarse grains and the like, which results in the problems of imperfection of the secondary recrystallization, reduced magnetic induction and the like.

SUMMARY OF THE INVENTION

The object of the present invention is to provide a manufacturing method of common oriented silicon steel having high magnetic induction. By adopting the manufacturing method, the common oriented silicon steel having high magnetic induction (B8≥1.88 T) can be obtained only using primary aging-free rolling on the premise of eliminating normalizing, intermediate annealing and other procedures.

In order to realize the object of the present invention, the present invention provides a manufacturing method of common oriented silicon steel having high magnetic induction, comprising the following steps:

(1) smelting and continuously casting to obtain a slab, wherein a content of N is controlled in a range of 0.002-0.014 wt % in the smelting stage;

(2) hot-rolling, wherein the heating temperature is 1090-1200° C.;

(3) cold-rolling: wherein a primary aging-free rolling is performed;

(4) decarbonizing and annealing;

(5) nitriding treatment, wherein infiltrated nitrogen content $[N]_D$ satisfies the following formula: $328-0.14a-0.85b-2.33c \leq [N]_D \leq 362-0.16a-0.94b-2.57c$, wherein a is the content of Als in the smelting step, with the unit of ppm; b is the content of N element in the smelting step, with the unit of ppm; and c is the size of primary grains, with the unit of μm;

(6) coating a magnesium oxide layer on a steel plate's surfaces and annealing; and (7) applying an insulation coating.

Through a large number of tests, the inventor finds that, by appropriately controlling the content of N in the steel making process, not only a product with high magnetic induction can be obtained, but also the normalizing, intermediate annealing and other procedures can be eliminated, and the secondary cold-rolling method is converted to the primary cold-rolling method, thereby reducing the production period and obviously improving the production efficiency.

Because the nitriding treatment still needs to be performed after the decarbonizing and annealing procedure in the technical solution, the content of N needs to be controlled within a low range in the smelting stage, and thereby avoiding to use high temperature for heating, and the technical solution adopts a low-temperature slab heating technology at 1090-1200° C. for production and manufacturing. In the technical solution, when the content of N is less than 0.002%, the effect of a primary inhibitor can not be stably obtained, the control of primary recrystallization size becomes difficult and the secondary recrystallization is not perfect, either. At this time, the intermediate annealing and the secondary cold-rolling processes need to be adopted to improve the magnetic property of a finished product. However, when the content of N exceeds 0.014%, in the actual production process, not only the reheating temperature for the slab needs to be increased to 1350° C. or more, but also the Goss orientation degree is also reduced due to the nitriding treatment in the subsequent procedure. In addition, when the content of N is high, the normalizing procedure still needs to be added to realize small and dispersed precipitation of the MN inhibitor, and a primary cold-rolling aging control process is adopted to obtain a cold-rolled plate with the thickness of the final finished product. Thus, in view of the magnetic property, the production efficiency and the various comprehensive factors of the finished product, in the technical solution of the present invention, the content of N needs to be controlled at 0.002-0.014 wt %.

The nitriding treatment in the technical solution is directed to the low-temperature slab heating technology in the technical solution, and the nitriding treatment is performed on the cold-rolled and decarbonized plate so as to supplement for the insufficient strength of the inhibitor in a base plate; and the added inhibitor is a special secondary inhibitor for secondary recrystallization, and the amount thereof directly decides the degree of perfection of secondary recrystallization of the decarbonized steel plate in the high-temperature annealing process. When the content of the infiltrated N in the nitriding treatment is too small, the strength of the inhibitor is weak, and thus the positions of crystal nuclei of the secondary recrystallization are extended to the plate thickness direction, so that the near-surface layer of the steel plate has sharp Goss orientation, and the normal crystal grains of the central layer are also subject to secondary recrystallization, such that the degree of orientation becomes poor, the magnetic property is deteriorated, and the $B_8$ of the finished product is reduced. On the contrary, when the content of the infiltrated N in the nitriding treatment is too large, the degree of Goss orientation is also greatly deteriorated, and metal defects will expose on a magnesium silicate glass film formed in the high-temperature annealing process and the defect ratio is significantly increased.

Thus, the infiltrated N content in the nitriding treatment should satisfy the following relation formula: $328-0.14a-0.85b-2.33c \leq [N]_D \leq 362-0.16a-0.94b-2.57c$, (a is the content of Als in the smelting step, with the unit of ppm; b is the content of N element in the smelting step, with the unit of ppm; and c is primary grains size, with the unit of μm).

Furthermore, in the above step (2), the hot-rolling begins at a temperature of 1180° C. or less, and ends at a temperature of 860° C. or more, and a coiling after the hot-rolling is performed aat a temperature less than 650° C.

Furthermore, in the above step (3), the cold rolling reduction ratio is controlled to be not less than 80%.

Furthermore, in the above step (4), the heating rate is controlled at 15-35° C./s, the decarbonizing temperature is controlled at 800-860° C. and the decarbonizing dew point is controlled at 60-70° C.

Furthermore, in the above step (4), a protective atmosphere is 75% $H_2$+25% $N_2$ (volume fraction).

Furthermore, in the above step (5), nitriding is performed by $NH_3$ having the volume fraction of 0.5-4.0%, at a nitriding temperature of 760-860° C., with a nitriding time of 20-50 s and with a oxidation degree $P_{H2O}/P_{H2}$ of 0.045-0.200.

Compared with the prior art, in the manufacturing method of the common oriented silicon steel with high magnetic induction according to the present invention, by controlling the content of N in the smelting process and controlling infiltrated nitrogen content in the nitriding treatment of the subsequent process according to the content of Als, the content of N element and the primary grains size in the smelting step, under the premise of reducing the production process flow, the common oriented silicon steel with the high magnetic induction (B8≥1.88 T) is obtained. Thus, not only the production procedures are reduced, the production efficiency is improved, but also the common oriented silicon steel is ensured to have a ideal magnetic performance and a excellent orientation degree.

DETAILED DESCRIPTION OF THE EMBODIMENTS

The technical solution of the present invention is further explained and illustrated below in conjunction with specific examples and comparative examples.

Examples 1-3 and Comparative Examples 1-2

Steel making is performed by adopting a converter or an electric furnace, a slab is obtained by secondary refining of molten steel and continuous casting, and the slab comprises the following chemical elements by weight percent: 0.02-0.08% of C, 2.0-3.5% of Si, 0.05-0.20% of Mn, 0.005-0.012% of S, 0.010-0.060% of Als, 0.002-0.014% of N, not more than 0.10% of Sn and the balance of Fe and other inevitable impurities. The slabs with different components are heated at the temperature of 1150° C. and then hot-rolled to hot-rolled plates with the thickness of 2.3 mm, initial rolling and final rolling temperatures are 1070° C. and 935° C. respectively and the coiling temperature is 636° C. After acid washing, the hot-rolled plates are subject to primary cold-rolling so as to obtain finished products with the thickness of 0.30 mm. Decarbonizing and annealing are performed under the conditions that the heating rate during decarbonizing and annealing is 25° C./s, the decarbonizing temperature is 845° C. and the decarbonizing dew point is 67° C., thereby reducing the content of [C] in the steel plates to be 30 ppm or less. Nitriding treatment process: 780° C.×30 sec, the oxidation degree $P_{H2O}/P_{H2}$ is 0.065, the amount of $NH_3$ is 3.2 wt % and the content of infiltrated [N] is 160 ppm. An isolation agent using MgO as a main component is coated on each steel plate, and then high-temperature annealing is performed in a batch furnace. After uncoiling, by applying insulating coatings and performing stretching, leveling and annealing, $B_8$ and the production period of obtained finished product are as shown in Table 1.

TABLE 1

(The balance is Fe and other inevitable impurities, wt %)

| Ser. No. | C (%) | Si (%) | Mn (%) | S (%) | Als (%) | N (%) | Sn (%) | B8 (T) | Process | Hot-rolling--cold-rolling production period |
|---|---|---|---|---|---|---|---|---|---|---|
| 1 | 0.04 | 2.0 | 0.10 | 0.012 | 0.03 | 0.014 | 0.04 | 1.90 | Normalizing-free and intermediate annealing-free, primary cold-rolling method | ≤48 h |
| 2 | 0.06 | 3.5 | 0.20 | 0.005 | 0.06 | 0.008 | 0.10 | 1.88 | | |
| 3 | 0.08 | 3.0 | 0.05 | 0.006 | 0.01 | 0.002 | 0.06 | 1.89 | | |
| 4 | 0.05 | 3.2 | 0.15 | 0.006 | 0.03 | 0.016 | 0.06 | 1.85 | Normalizing, primary cold-rolling method | 48-56 h |
| 5 | 0.07 | 2.6 | 0.12 | 0.007 | 0.04 | 0.001 | 0.05 | 1.84 | Intermediate annealing, secondary cold-rolling method | 55-65 h |

(Serial numbers 1-3 are examples 1-3 respectively and serial numbers 4-5 are comparative examples 1-2 respectively)

It can be seen from Table 1 that, when the content of N element is controlled within the range of 0.002-0.014%, the finished products generally have the high magnetic induction, which can achieve $B_8$ of not less than 1.88 T. On the contrary, the N element in each of comparative examples 1-2 does not satisy the technical solution of the present invention, and thus the magnetic induction thereof is lower than that in each of examples 1-3.

In addition, it also can be seen from Table 1 that, when the content of N in the smelting stage is within the range of 0.002-0.014%, the steps of normalizing and intermediate annealing can be avoided, and a primary cold-rolling process technology is simultaneously adopted, so that the production period from the hot-rolled plate to the final finished product (namely the cold-rolled plate) is controlled within 48 h.

Otherwise, when the content of N does not meet the requirements, as the procedures of normalizing, intermediate annealing, secondary cold-rolling and the like are required, the production period will be prolonged by about 5-20 h.

Examples 4-8 and Comparative Examples 3-7

Steel making is performed by adopting a converter or an electric furnace, a slab is obtained by secondary refining of molten steel and continuous casting, and the slab comprises the following chemical elements by weight percent: 3.0% of Si, 0.05% of C, 0.11% of Mn, 0.007% of S, 0.03% of Als, 0.007% of N, 0.06% of Sn and the balance of Fe and inevitable impurities; and then hot-rolling is performed, and the different hot-rolling process conditions are as shown in Table 2. After acid washing, the hot-rolled plates are subject to primary cold-rolling so as to obtain finished products with the thickness of 0.30 mm. Decarbonizing and annealing are performed under the conditions that the heating rate during decarbonizing and annealing is 25° C./s, the decarbonizing temperature is 840° C. and the decarbonizing dew point is 70° C., thereby reducing the content of [C] in the steel plates to be 30 ppm or less. Nitriding treatment process: 800° C.×30 sec, the oxidation degree $P_{H2O}/P_{H2}$ is 0.14, the amount of $NH_3$ is 1.1 wt % and the content of infiltrated [N] is 200 ppm. An isolation agent using MgO as a main component is coated on each steel plate, and then high-temperature annealing is performed in a batch furnace. After uncoiling, by applying insulating coatings and performing stretching, leveling and annealing, B8 of obtained finished product is as shown in Table 2.

TABLE 2

| Ser. No. | Heating temperature of slab (° C.) | Initial rolling temperature (° C.) | Final rolling temperature (° C.) | Coiling temperature (° C.) | B8 (T) |
|---|---|---|---|---|---|
| Example 4 | 1090° C. | 1060 | 945 | 576 | 1.88 |
| Example 5 | 1200° C. | 1070 | 880 | 628 | 1.89 |
| Example 6 | 1150° C. | 1180 | 940 | 564 | 1.89 |
| Example 7 | 1130° C. | 1050 | 860 | 550 | 1.88 |
| Example 8 | 1100° C. | 1065 | 930 | 650 | 1.90 |
| Comparative example 3 | 1085° C. | 1090 | 905 | 625 | 1.83 |
| Comparative example 4 | 1205° C. | 1054 | 885 | 589 | 1.85 |
| Comparative example 5 | 1105° C. | 1185 | 936 | 640 | 1.85 |
| Comparative example 6 | 1160° C. | 1081 | 850 | 580 | 1.84 |
| Comparative example 7 | 1135° C. | 1140 | 920 | 660 | 1.84 |

It can be seen from the results in Table 2 that, when the hot-rolling process satisfies the following conditions: the slab is heated to 1090-1200° C. in a heating furnace, the initial rolling temperature is 1180° C. or less, the final rolling temperature is 860° C. or more, laminar cooling is performed after rolling, and coiling is performed at the temperature of 650° C. or less, examples 4-8 generally have higher magnetic induction, which can achieve B8 of not less than 1.88 T. On the contrary, when the hot-rolling process is not in line with the technical solution, comparative examples 3-7 have lower magnetic induction than the examples.

Examples 9-13 and Comparative Examples 8-13

Steel making is performed by adopting a converter or an electric furnace, a slab is obtained by secondary refining of molten steel and continuous casting, and the slab comprises the following chemical elements by weight percent: 2.8% of Si, 0.04% of C, 0.009% of S, 0.04% of Als, 0.005% of N, 0.10% of Mn, 0.03% of Sn and the balance of Fe and inevitable impurities. The slabs are heated at the temperature of 1130° C. and hot-rolled to hot-rolled plates with the thickness of 2.5 mm, initial rolling and final rolling temperatures are 1080° C. and 920° C. respectively and the coiling temperature is 605° C. The hot-rolled plates are cold-rolled to finished products with the thickness of 0.35 mm after acid washing, then decarbonizing and annealing are performed, and the different decarbonizing and annealing process conditions are as shown in Table 3.

After decarbonizing and annealing, the content of [C] in steel plates is reduced to be 30 ppm or less. Nitriding treatment process: 800° C.×30 sec, the oxidation degree $P_{H2O}/P_{H2}$ is 0.15, the amount of $NH_3$ is 0.9 wt % and the content of infiltrated [N] is 170 ppm. An isolation agent using MgO as a main component is coated on each steel plate, and then high-temperature annealing is performed in a batch furnace. After uncoiling, by applying insulating coatings and performing stretching, leveling and annealing, $B_8$ of obtained finished product is as shown in Table 3.

TABLE 3

| Ser. No. | heating rate during decarbonizing (° C./s) | Decarbonizing temperature (° C.) | Decarbonizing dew point (° C.) | $B_8$ (T) |
|---|---|---|---|---|
| Example 9 | 15 | 800 | 66 | 1.88 |
| Example 10 | 20 | 860 | 62 | 1.89 |
| Example 11 | 25 | 815 | 70 | 1.89 |
| Example 12 | 30 | 830 | 60 | 1.90 |
| Example 13 | 35 | 845 | 68 | 1.90 |
| Comparative example 8 | 13 | 810 | 64 | 1.82 |
| Comparative example 9 | 38 | 830 | 68 | 1.85 |
| Comparative example 10 | 26 | 795 | 66 | 1.83 |
| Comparative example 11 | 18 | 865 | 60 | 1.81 |
| Comparative example 12 | 30 | 845 | 72 | 1.83 |
| Comparative example 13 | 22 | 855 | 58 | 1.84 |

It can be seen from Table 3 that, when the decarbonizing and annealing process satisfies the conditions that the heating rate during decarbonizing is 15-35° C./sec, the decarbonizing temperature is 800-860° C. and the decarbonizing dew point is 60-70° C., the finished products in examples 9-13 generally have higher magnetic induction, which can achieve $B_8$ of not less than 1.88 T. On the contrary, when the decarbonizing and annealing process is not in line with the technical solution, comparative examples 8-13 generally have lower magnetic induction.

Examples 14-23 and Comparative Examples 14-19

Steel making is performed by adopting a converter or an electric furnace, a slab is obtained by secondary refining of molten steel and continuous casting, and the slab comprises the following chemical elements by weight percent: 3.0% of Si, 0.05% of C, 0.11% of Mn, 0.007% of S, 0.03% of Als, 0.007% of N, 0.06% of Sn and the balance of Fe and inevitable impurities. The slabs are heated at the temperature of 1120° C. and hot-rolled to hot-rolled plates with the thickness of 2.5 mm, initial rolling and final rolling temperatures are 1080° C. and 920° C. respectively and the coiling temperature is 605° C. After acid washing, the hot-rolled plates are subject to cold-rolling to obtain finished products with the thickness of 0.35 mm. Then, decarbonizing and annealing are performed under the conditions that the heating rate is 30° C./sec, the decarbonizing temperature is 840° C. and the decarbonizing dew point is 68° C. Then, nitriding treatment is performed and the different nitriding and annealing process conditions are as shown in Table 4. An isolation agent using MgO as a main component is coated on each steel plate, and then high-temperature annealing is performed in a batch furnace. After uncoiling, by applying insulating coatings and performing stretching, leveling and annealing, B8 of obtained finished product is as shown in Table 4.

TABLE 4

| Ser. No. | Nitriding temperature (° C.) | Nitriding time (sec) | Nitriding $P_{H2O}/P_{H2}$ | $NH_3$ (%) | Content of infiltrated N (ppm) | $B_8$ (T) |
|---|---|---|---|---|---|---|
| Example 14 | 760 | 45 | 0.150 | 3.8 | 245 | 1.89 |
| Example 15 | 860 | 25 | 0.120 | 1.0 | 105 | 1.90 |
| Example 16 | 780 | 20 | 0.050 | 2.4 | 130 | 1.90 |
| Example 17 | 770 | 50 | 0.085 | 1.8 | 185 | 1.88 |
| Example 18 | 820 | 40 | 0.045 | 3.5 | 110 | 1.89 |
| Example 19 | 840 | 35 | 0.200 | 0.5 | 205 | 1.90 |
| Example 20 | 850 | 30 | 0.185 | 0.6 | 215 | 1.89 |
| Example 21 | 830 | 30 | 0.105 | 4.0 | 190 | 1.89 |
| Example 22 | 810 | 35 | 0.070 | 1.2 | 70 | 1.88 |
| Example 23 | 790 | 40 | 0.095 | 2.6 | 280 | 1.89 |
| Comparative example 14 | 750 | 30 | 0.100 | 2.0 | 230 | 1.86 |
| Comparative example 15 | 870 | 15 | 0.100 | 2.5 | 215 | 1.84 |
| Comparative example 16 | 820 | 55 | 0.040 | 2.0 | 100 | 1.84 |
| Comparative example 17 | 830 | 30 | 0.205 | 0.4 | 150 | 1.85 |
| Comparative example 18 | 830 | 40 | 0.160 | 4.1 | 285 | 1.83 |
| Comparative example 19 | 820 | 40 | 0.075 | 1.0 | 65 | 1.82 |

It can be seen from the test results in Table 4 that, when the nitriding and annealing process satisfies the technical solution, namely the nitriding temperature is 760-860° C., the nitriding time is 20-50 sec, the oxidation degree $P_{H2O}/P_{H2}$ is 0.045-0.200, the content of $NH_3$ is 0.5-4.0 wt % and the content of infiltrated N satisfies the formula: $328-0.14a-0.85b-2.33c \leq [N]_D \leq 362-0.16a-0.94\ b-2.57c$, examples 14-23 generally have higher magnetic induction, which can achieve $B_8$ of not less than 1.88 T. On the contrary, when the nitriding and annealing process is not in line with the technical solution, comparative examples 14-19 generally have lower magnetic induction.

Examples 24-29 and Comparative Examples 20-25

Steel making is performed by adopting a converter or an electric furnace, a slab is obtained by secondary refining of molten steel and continuous casting, and the slab comprises the following chemical elements by weight percent: 2.8% of Si, 0.045% of C, 0.06% of Mn, 0.009% of S, 0.024% of Als, 0.009% of N, 0.04% of Sn and the balance of Fe and inevitable impurities. The slabs are heated at the temperature of 1120° C. and hot-rolled to hot-rolled plates with the thickness of 2.3 mm, initial rolling and final rolling temperatures are 1070° C. and 900° C. respectively and the coiling temperature is 570° C. After acid washing, the hot-rolled plates are subject to cold-rolling to obtain finished products with the thickness of 0.30 mm. Then, decarbonizing and annealing are performed under the conditions that the heating rate is 20° C./sec, the decarbonizing temperature is 830° C. and the decarbonizing dew point is 70° C. Then, nitriding treatment is performed, and the effects of different contents of infiltrated N on $B_8$ of the finished products are as shown in Table 5. An isolation agent using MgO as a main component is coated on each steel plate, and then high-temperature annealing is performed in a batch furnace. After uncoiling, by applying insulating coatings and performing stretching, leveling and annealing, $B_8$ of each finished product is as shown in Table 5.

TABLE 5

| Ser. No. | Steel making [Als] (ppm) a | Steel making [N] (ppm) b | Primary grains size (μm) c | Calculated content of infiltrated N (ppm) $[N]_{D\ calculated}$ | Actual content of infiltrated N (ppm) $[N]_{D\ actual}$ | $B_8$ (T) |
|---|---|---|---|---|---|---|
| Example 24 | 100 | 120 | 23.6 | 157-173 | 161 | 1.90 |
| Example 25 | 200 | 40 | 22.2 | 214-235 | 220 | 1.90 |
| Example 26 | 300 | 60 | 21.0 | 186-204 | 192 | 1.89 |
| Example 27 | 400 | 140 | 19.9 | 107-115 | 110 | 1.90 |
| Example 28 | 500 | 20 | 22.7 | 188-205 | 188 | 1.89 |
| Example 29 | 600 | 130 | 17.2 | 93-100 | 100 | 1.88 |
| Comparative example 20 | 100 | 120 | 23.6 | 157-173 | 177 | 1.84 |
| Comparative example 21 | 200 | 40 | 22.2 | 214-235 | 240 | 1.85 |
| Comparative example 22 | 300 | 60 | 21.0 | 186-204 | 180 | 1.83 |
| Comparative example 23 | 400 | 140 | 19.9 | 107-115 | 96 | 1.82 |
| Comparative example 24 | 500 | 20 | 22.7 | 188-205 | 221 | 1.83 |
| Comparative example 25 | 600 | 130 | 17.2 | 93-100 | 80 | 1.82 |

Table 5 reflects the effects of the contents of the infiltrated N on $B_8$ of the finished products. It can be seen from Table 5 that, the content of the infiltrated N needs to satisfy the content of the infiltrated nitrogen $[N]_D$ ($328-0.14a-0.85b-2.33c \leq [N]_D \leq 362-0.16a-0.94b-2.57c$) obtained by a theoretical calcualtion based on the content a of Als, the content b of N and the primary grains size c in the smelting stage. When the actual amount of the infiltrated N is within the range of the calculated values, such as examples 24-29, the finished products have higher magnetic induction; and on the contrary, such as comparative examples 20-25, the finished products have lower magnetic induction.

It should be noted that the examples listed above are only the specific examples of the present invention, and obviously the present invention is not limited to the above examples and can have many similar changes. All variations which can be directly derived from or associated with the disclosure of the present invention by those skilled in the art should be within the scope of protection of the present invention.

The invention claimed is:

1. A manufacturing method of common oriented silicon steel having high magnetic induction, comprising the following steps:

(1) smelting and continuous casting to obtain a slab, wherein the content of N is controlled in a range of 0.002-0.014 wt % in the smelting stage;

(2) hot-rolling, wherein a heating temperature is 1090-1200° C.;

(3) cold-rolling, wherein a primary aging-free rolling is performed;

(4) decarbonizing and annealing;

(5) nitriding treatment, wherein infiltrated nitrogen content $[N]_D$ satisfies the following formula: $328-0.14a-0.85b-2.33c \leq [N]_D \leq 362-0.16a-0.94b-2.57c$, wherein a is the content of Als in the smelting step, with a unit of ppm; b is the content of N element in the smelting step, with a unit of ppm; and c is the size of primary grains, with a unit of μm;

(6) coating a magnesium oxide layer on a steel plate's surfaces, and annealing; and (7) coating an insulation layer.

2. The manufacturing method of common oriented silicon steel having high magnetic induction according to claim 1, wherein in the step (2), the hot-rolling begins at a temperature of 1180° C. or below, and ends at a temperature of 860° C. or above, and then a coiling after the hot-rolling is performed at a temperature of below 650° C.

3. The manufacturing method of common oriented silicon steel having high magnetic induction according to claim 2, wherein in said step (3), a cold-rolling reduction ratio is not less than 80%.

4. The manufacturing method of common oriented silicon steel having high magnetic induction according to claim 3, wherein in the step (4), a heating rate is 15-35° C./s, a decarbonizing temperature is 800-860° C., and a decarbonizing dew point is 60-70° C.

5. The manufacturing method of common oriented silicon steel having high magnetic induction according to claim 4, wherein in the step (4), a protective atmosphere is 75% $H_2$+25% $N_2$.

6. The manufacturing method of common oriented silicon steel having high magnetic induction according to claim 1, wherein in the step (5), the nitriding is performed by $NH_3$ with a volume fraction of 0.5-4.0%, at a temperature of 760-860° C., within a time of 20-50 s, and in an oxidation degree $P_{H2O}/P_{H2}$ of 0.045-0.200.

* * * * *